US005971291A

United States Patent [19]

Moroi et al.

[11] Patent Number: 5,971,291

[45] Date of Patent: Oct. 26, 1999

[54] HEAT GENERATING APPARATUS EMPLOYING VISCOUS FLUID

[75] Inventors: Takahiro Moroi; Takashi Ban; Kiyoshi Yagi; Hidefumi Mori; Tatsuya Hirose, all of Kariya, Japan

[73] Assignee: Kabushiki Kaisha Toyoda Jodoshokki Seisakusho, Aichi-ken, Japan

[21] Appl. No.: 09/128,690

[22] Filed: Aug. 4, 1998

[30] Foreign Application Priority Data

Aug. 5, 1997 [JP] Japan ..... 9-210784

[51] Int. Cl.[6] ..... B60H 1/02

[52] U.S. Cl. ..... 237/12.3 R; 122/26; 126/247

[58] Field of Search ..... 237/12.3 R, 12.3 B; 122/26; 126/247; 123/142.5 R

[56] References Cited

U.S. PATENT DOCUMENTS 4,664,068 5/1987 Kretchmar et al. ..... 122/26
4,685,443 8/1987 McMurtry ..... 126/247
4,974,778 12/1990 Bertling ..... 237/12.3 R
4,993,377 2/1991 Itakura ..... 123/142.1 R
5,573,184 11/1996 Martin ..... 237/12.3 R
5,842,636 12/1998 Moroi et al. ..... 237/12.3 B

*Primary Examiner*—Henry Bennett
*Assistant Examiner*—Derek S. Boles
*Attorney, Agent, or Firm*—Woodcock Washburn Kurtz Mackiewicz & Norris LLP

[57] ABSTRACT

A heat generating apparatus having a housing assembly in which a working chamber including a heat generating region for heat generation and a fluid storing region for storing a viscous fluid, and a heat receiving chamber for receiving heat from the heat generating region are formed. The heat generating apparatus also having a rotor element mounted on a drive shaft to be rotated within the working chamber to apply a shearing action to the viscous fluid within the heat generating region. The viscous fluid generates heat when the shearing action is applied thereto so that the heat is transmitted to a heat exchanging liquid flowing through the heat receiving chamber. The heat generating region and fluid storing region communicating through an aperture formed in a partition wall formed in the working chamber, and the aperture having a gas-phase portion, a liquid-phase portion and a liquid supply portion.

8 Claims, 8 Drawing Sheets

HEAT GENERATING APPARATUS EMPLOYING VISCOUS FLUID

BACKGROUND OF THE INVENTION

1. Field of the Invention

The present invention relates to a heat generating apparatus, non-exclusively used as a heat source for a vehicle heating system, and operating on the principle that a viscous fluid subjected to a shearing action due to the rotation of a rotor element generates heat which is received by a heat exchanging liquid circulating through a heat receiving chamber and is carried to an objective heated area.

2. Description of the Related Art

Japanese Unexamined Patent Publication No. 8-337110 (the corresponding European Patent Publication is No. 0687584 A1 and the corresponding U.S. Patent Publication is U.S. Pat. No. 5,573,184) discloses a heat generating apparatus adapted for use in a heating system incorporated in an automotive vehicle. The heating apparatus includes a housing in which a heat generating chamber and a heat receiving chamber, or a water jacket arranged adjacent to the heat generating chamber, are defined. The housing rotatably supports a drive shaft via a bearing and a shaft sealing device. An outer end of the drive shaft and the housing support thereon a solenoid clutch which acts so as to connect the drive shaft to a vehicle engine via a belt-and-pulley mechanism, and to disconnect the drive shaft from the vehicle engine as required. The drive shaft has an inner end extending into the heat generating chamber and a rotor element is formed integrally therewith to be rotated with the drive shaft within the heat generating chamber. The heat generating chamber has an inner wall surface which cooperates with outer faces of the rotor element to define gaps therebetween in which a viscous fluid such as silicone oil is confined to generate heat. Namely, when the above-mentioned heating apparatus is incorporated in the vehicle heating system, the rotor element integral with the drive shaft is rotationally driven by the vehicle engine, and accordingly, the viscous fluid in the heat generating chamber is subjected to a shearing action by which the viscous fluid generates heat within the gaps between the inner wall surface of the heat generating chamber and the outer faces of the rotor element. The heat is transmitted to the engine cooling water flowing through the water jacket via the wall of the heat generating chamber, and therefore, the heat transmitted to the engine cooling water is carried to a heating circuit in which the heat is moved to the air with the vehicle compartment.

In the heat generating apparatus of JP-A-'110, the viscous fluid within the heat generating chamber is constantly being subjected to the shearing action to generate heat during the rotation of the rotor element and the drive shaft. Therefore, the viscous fluid within the gaps between the inner wall surface of the heat generating chamber and the outer faces of the rotor element constantly can hold heat to become excessively hot. As a result, the viscous fluid is apt to be thermally degraded, and also be physically degraded due to the cutting of the molecular chains in the viscous fluid which reduces the molecular weight thereof. Thus, the viscosity of the viscous fluid is decreased so as to cause a reduction in the heat generating performance of the viscous fluid, and the operating life of the viscous fluid is shortened. Replacement of the degraded viscous fluid having a reduced viscosity with a fresh viscous fluid requires removing the heat generating apparatus from the vehicle and disassembly of the apparatus per se. The removed and disassembly of the heat generating apparatus is very cumbersome and inconvenient.

Further, according to an experiment conducted by the present Applicant with respect to the heat generating apparatus, when the apparatus is driven under a specified severe operating condition, such as a high speed and lengthy operating condition, it was found that leakage of the viscous fluid from the apparatus occurs. The heat generating apparatus of JP-A-'110 aims to achieve a simpler construction thereof while the viscous fluid within the heat generating chamber is added at a filing rate of 100%. Therefore, a thermal expansion of the viscous fluid within the heat generating chamber due to heat generation is absorbed by an expandable elastic membrane which also functions as a shaft sealing element, and a compensating chamber arranged between the shaft sealing element and a bearing device for rotatably support the drive shaft. Thus, when the heat generating apparatus is operated at a nominal rotating speed of the drive shaft for a relatively short period of time, leakage of the viscous fluid does not occur. Nevertheless, when the apparatus is operated at a very high rotating speed of the drive shaft or when the apparatus is operated at the nominal operating speed of the drive shaft for a long period of time, the thermal expansion of the viscous fluid cannot be absorbed by the elastic deformation of the elastic membrane and a reduction in the volume of the compensating chamber to result in leakage of the viscous fluid. Since the leakage of the viscous fluid reduces the amount of viscous fluid held in the heat generating chamber, viscous fluid must be added to the heat generating chamber by disassembling the heat generating apparatus mounted in, e.g., an engine compartment of the vehicle. Further, the viscous fluid gradually leaking from the heat generating apparatus causes contamination in the engine compartment.

Furthermore, in the heat generating apparatus of JP-A-'110, the heat generating chamber is entirely filled with the viscous fluid, i.e., the filling rate of the viscous fluid for the heat generating chamber is approximately 100%. Therefore, an initial torque to start the rotation of the drive shaft and the rotor element is very large. Accordingly, at the starting of the vehicle engine, various problems, in which a cranking motor of the engine fails due to an excessive load applied to the motor and the solenoid clutch and the pulley-belt, slip occur. Also, the starting of the heat generating apparatus during the running of the vehicle provides a driver with an unpleasant feeling caused by the starting shock of the apparatus.

U.S. Pat. No. 4,974,778 and the corresponding German Patent Publication DE-3832966-A1 disclose a viscous fluid type heat generating apparatus provided with a housing in which a heat chamber and a fluid supply chamber communicating with the heat chamber via a fluid-supplying passage and a fluid-returning passage. The heating and fluid storage chambers are filled with a viscous fluid and a given amount of air. Thus, the viscous fluid can be supplied from the fluid supply chamber to the heating chamber, and also returned from the heat generating chamber to the fluid supply chamber. Accordingly, degradation of the viscous fluid can be prevented.

Further, in the heat generating apparatus of U.S. Pat. No. 4,974,778, an amount of the viscous fluid held in the apparatus can be reduced at the start of the operation thereof, and accordingly, a starting torque necessary for starting the heat generating apparatus can be reduced.

Nevertheless, according to an experiment on the heat generating apparatus of U.S. Pat. '778, conducted by the present Applicant, it was confirmed that when the apparatus is operated under a severe operating condition, i.e., under a high-speed continuous-running condition, the apparatus may allow leakage of the viscous fluid from the apparatus.

Namely, in the heat generating apparatus, the fluid-supplying passage and the fluid-returning passage are separately formed in a partition wall between the heat generating chamber and the fluid supplying chamber. Thus, the heat generating chamber and the fluid supplying chamber communicate with one another only by the fluid-supplying and fluid-returning passages. The fluid supplying passage is usually closed by a closing element and the fluid returning passage is constantly kept open. Accordingly, the fluid returning passage works as a throttling orifice opening from the heat generating chamber toward the fluid supplying chamber. As a result, a pressure level in the heat generating chamber increases during a high-speed continuous-running condition and causes leakage of the viscous fluid from the heating chamber.

Japanese Unexamined Patent Publication (Kokai) No. 2-246823 and the corresponding U.S. Pat. No. 4,993,377 disclose a viscous fluid type heat generator for an automobile which is provided with a heat generating chamber in which a heat generating chamber is formed so as to fluidly communicate with a vacant space arranged adjacent to an innermost end of a drive shaft on which a rotor element is mounted so as to be rotated together with the drive shaft. The heat generating chamber and the vacant space may be filled with viscous fluid. If the vacant space is supplied with a given amount of air, a thermal expansion of the viscous fluid in the heat generating chamber can be absorbed by volumetric reduction in the air in the vacant space fluidly communicating with the heat generating chamber. Thus, the viscous fluid can be prevented from leaking from the heat generator.

Nevertheless, the heat generator of JP-A-'823 is provided with coaxially extending labyrinth recesses formed by cooperation between axial projections of an inner wall surface of the heat generating chamber and alternate axial projections of outer faces of the rotor element. The labyrinth recesses prevent the viscous fluid held in the heat generating chamber from circulating in the heat generating chamber. Accordingly, the physical and chemical properties of the viscous fluid must be degraded during the continuous use of the viscous fluid type heat generator.

SUMMARY OF THE INVENTION

Therefore, a main object of the present invention is to obviate defects encountered in the conventional viscous fluid type heat generating apparatus as disclosed in the above-mentioned three publications.

Another object of the present invention is to provide a heat generating apparatus capable of preventing degradation of the viscous fluid, reducing a starting torque necessary for starting the operation thereof, and avoiding leakage of the viscous fluid from the apparatus even if it is used under a very severe operating condition.

In accordance with the present invention, there is provided a heat generating apparatus which comprises:

- a housing assembly having a working chamber for heat generation, and a heat receiving chamber arranged adjacent to the working chamber and permitting a heat receiving liquid to flow therethrough;
- a drive shaft having outer and inner opposite ends and rotatably supported in the housing assembly via a bearing unit;
- a rotor element supported on the drive shaft to be rotatable in the working chamber and having outer faces thereof; and
- a viscous fluid and a given amount of air filled within the working chamber;

wherein the working chamber defines therein:

- a heat generating region including a heat generating gap formed between the outer faces of the rotor element and an inner wall surface of the working chamber to generate heat when the viscous fluid is subjected to a shearing action within the heat generating gap by the rotation of the rotor element, and
- a fluid storing region forming the remainder of the working chamber and storing a predetermined amount of viscous fluid of which the volume is larger than that of the heat generating gap, the fluid storing region being arranged for permitting the viscous fluid to move from the heat generating region thereto and vice versa.

In the above-described heat generating apparatus of the present invention, the viscous fluid is allowed to perform a circulatory movement through the heat generating region and the fluid storing region of the working chamber during the rotation of the drive shaft, and therefore, no specified part of the viscous fluid is subjected to the shearing action within the heat generating region by the rotation of the rotor element. Namely, since a part of the viscous fluid held in the heat generating region of the working chamber is constantly replaced with another part of the viscous fluid, an early degradation of the viscous fluid within the heat generating region can be prevented. Therefore, the viscosity of the viscous fluid filled in the heat generating apparatus is unchanged over a long operating time, i.e., the viscous fluid filled in the heat generating apparatus is durable throughout a long operating life of the heat generating apparatus, and does not need to be replaced with fresh viscous fluid. As a result, once the heat generating apparatus is mounted on a vehicle, disassembling of the heat generating apparatus is not required and, accordingly, the heat generating apparatus of the present invention is desirable from the viewpoint of easy maintenance of the apparatus.

Further, in the above-described heat generating apparatus of the present invention, the working chamber including the heat generating region and fluid storing region is filled with a predetermined amount of air together with the viscous fluid. Thus, during the heat generating operation, thermal expansion of the viscous fluid held in the heat generating region can be absorbed by reduction in the volume of the air held in the fluid storing region of the working chamber. Furthermore, since the heat generating and liquid storing regions of the working chamber are in a constant fluid communication with one another, and since there is no throttling orifice between both regions, an excessive increase in the pressure within the working chamber does not occur even if the drive shaft and the rotor element are rotated within the working chamber either at a very high speed or at a normal speed but for a very long time. Therefore, it was experimentally confirmed that leakage of the viscous fluid from the working chamber of the apparatus does not occur even if the heat generating apparatus is operated under a very severe operating condition. From this, it was also confirmed that a reduction in the amount of the viscous fluid held in the working chamber of the heat generating apparatus does not occur during the long operating life thereof. Accordingly, contamination of a mounting space of the heat generating apparatus (e.g., a vehicle engine compartment) can be prevented. In addition, the heat generating apparatus is not required to be disassembled for a long operating life thereof.

Furthermore, since an amount of the viscous liquid held in the heat generating region of the working chamber can be reduced at the time of starting of the heat generating apparatus, it is possible to reduce an initial drive torque necessary for starting the rotation of the drive shaft and the rotor element. Therefore, a load applied to a vehicle engine can be reduced so that the vehicle on which the heat generating apparatus is mounted is not adversely affected by the apparatus. Therefore, the heat generating apparatus according to the present invention can achieve prevention of degradation of the viscous fluid, a reduction in the starting torque thereof, and prevention of leakage of the viscous fluid even under a very severe operating condition thereof such as a very high-speed condition or a continuous operating condition.

Preferably, the working chamber of the above-described heat generating apparatus has a partition wall arranged between the heat generating region and the fluid storing region, and the partition wall is provided with an aperture having an extension sufficient for providing a communication between the heat generating and fluid storing regions above the level of the viscous fluid stored in the fluid storing region. The partition wall having the above-mentioned communicating aperture and arranged between the heat generating and fluid storing regions promotes the circulatory movement of the viscous fluid through the heat generating and fluid storing regions.

Preferably, the partition wall is provided with an edge portion formed to oppose a rotating direction of the rotor element, and the aperture of the partition wall has a gas-phase communicating region defined by the edge portion and disposed in a gas-phase zone in the fluid storing region, and a liquid-phase communicating region disposed in a liquid-phase zone in the fluid storing region, and a liquid-supply region arranged to be integral with the liquid-phase communicating region and defined by the edge portion to extend in a direction corresponding to the rotating direction of the rotor element, the supplying portion being disposed at the lowest portion of the fluid storing region. Then, the gas-phase communicating region of the aperture of the partition wall can directly absorb thermal expansion of the viscous fluid in the heat generating region. The edge portion of the partition wall functions to guide the viscous fluid in the fluid storing region toward the liquid-supply region in response to the rotation of the rotor element, and the liquid-supply region functions to supply the viscous fluid into the heat generating region in the working chamber.

Preferably, the partition wall is provided with a fluid-collecting groove formed therein for conducting the viscous fluid from a circumferential region of the heat generating region to the aperture. Then, the viscous fluid conducted by the fluid-collecting groove is permitted to enter the fluid-storing region so that a quick circulatory movement of the viscous fluid occurs between the aperture and the fluid-supply region.

Alternatively, the fluid-collecting groove of the partition wall may communicate with the gas-phase communicating region of the aperture of the partition wall. Then, a large amount of viscous fluid may be conducted from the circumferential region of the heat generating region to the aperture, so that the collection of the viscous fluid from the heat generating region into the fluid-storing region is adequately achieved. Thus, the degradation of the viscous fluid is effectively prevented.

The fluid-collecting groove may communicate with the liquid-phase region of the aperture of the partition wall. Then, only a small amount of viscous fluid may be conducted from the circumferential region of the heat generating region to the aperture, so that collection of the viscous fluid into the fluid-storing region of the working chamber is suppressed. Thus, the heat generating apparatus can quickly generate heat at the starting time of the operation thereof.

In the heat generating apparatus according to the present invention, the rotor element may be provided with a recessed portion formed in a central portion thereof and a flange portion extending radially from the recessed portion. The recessed portion of the rotor element cooperates with the housing assembly to define the fluid storing region of the working chamber, and the flange portion cooperates with the housing assembly to define the heat generating region. The heat generating region communicates with the fluid storing region via communicating holes bored through the recessed portion at the outermost region thereof. Then, the fluid storing region of the working chamber is disposed in a region facing a recessed face of the rotor element so that the viscous fluid stored in the fluid storing region is forcedly moved into the recessed portion of the rotor element by a centrifugal force produced by the rotation of the rotor element. The viscous fluid moved into the recessed portion of the rotor element is further moved by the centrifugal force into the heat generating region facing a face of the rotor element opposite to the recessed face thereof, via the communicating holes. Thus, the communicating holes can function as a fluid-supply passage means from the fluid storing region to the heat generating region.

When the viscous fluid is supplied from the fluid storing region into the heat generating region via the above-mentioned communicating holes, the supplied viscous fluid presses the viscous fluid already held in the heat generating region so that the latter viscous fluid is forcedly moved from the heat generating gap between the inner wall surface of the working chamber and the outer faces of the rotor element toward the fluid storing region. Thus, the heat generating gap per se functions as a fluid collecting passage means from the heat generating region toward the fluid storing region. Therefore, an effective circulatory movement of the viscous fluid is positively caused in the working chamber of the heat generating apparatus so as to prolong the operating life of the viscous fluid. Namely, degradation of the viscous fluid is prevented.

Preferably, the working chamber is provided with a recessed portion formed therein to extend the fluid storing region so that a volume of the fluid storing region can be increased. Then, the above-mentioned effective circulatory movement of the viscous fluid is further promoted.

In the heat generating apparatus according to the present invention, the working chamber should preferably be provided with a guiding means such as a groove recessed in a part of the inner wall surface of the working chamber so that the guiding means conducts the viscous fluid from the heat generating region toward an outer circumference of the heat generating region. Then, the viscous fluid can be supplied from the heat generating region to the outer circumference thereof where an active heat generation of the viscous fluid due to the shearing action is performed. Thus, an active circulatory movement of the viscous fluid between the fluid storing region and the outer circumference of the heat generating region can be caused to prevent the thermal degradation of the viscous fluid. Further, the heat generating apparatus can quickly generate heat at the start of the operation thereof.

In the conventional heat generating apparatus as disclosed in U.S. Pat. '778 (DE-A-'966), the viscous fluid immediately after being collected into the fluid storing chamber from the heat generating chamber has a considerably high temperature compared with the other low temperature viscous fluid already stored in the fluid storing chamber.

Accordingly, there is a large temperature difference between the former and latter viscous fluids within the same fluid storing chamber. Obviously, the low temperature viscous fluid has a reduced fluidity compared with the high temperature viscous fluid. Accordingly, the viscous fluid within the fluid storing chamber exhibit a different physical properties depending on the location of each portion of the viscous fluid within the fluid storing chamber.

To the contrary, in the heat generating apparatus according to the present invention, the fluid storing region is arranged in the working chamber, and accordingly, the viscous fluid in the fluid storing region is stirred by the rotation of the rotor element rotating in the working chamber. Therefore, all portions of the viscous fluid in the fluid storing region are appropriately stirred and mixed with one another so as to exhibit a homogeneous physical property, i.e., the viscous fluid within the fluid storing region has an approximately identical temperature and an identical viscosity. Therefore, all portions of the viscous fluid in the storing region are constantly and continuously supplied into the heat generating region for heat generation. Thus, a long operating life of the viscous fluid can be ensured by the heat generating apparatus according to the present invention.

Preferably, the rotor element is provided with a stirring means for providing a stirring effect to the viscous fluid within the fluid storing region of the working chamber. Then, the stirring means of the rotor element positively stirs the viscous fluid in the fluid storing region of the working chamber, and accordingly, the afore-mentioned various advantages of the present invention can be surely obtained.

BRIEF DESCRIPTION OF THE DRAWINGS

The above and other objects, features and advantages of the present invention will be made more apparent from the ensuing description of preferred embodiments in conjunction with the accompanying drawings wherein.

DESCRIPTION OF THE PREFERRED EMBODIMENTS

Figure 1:
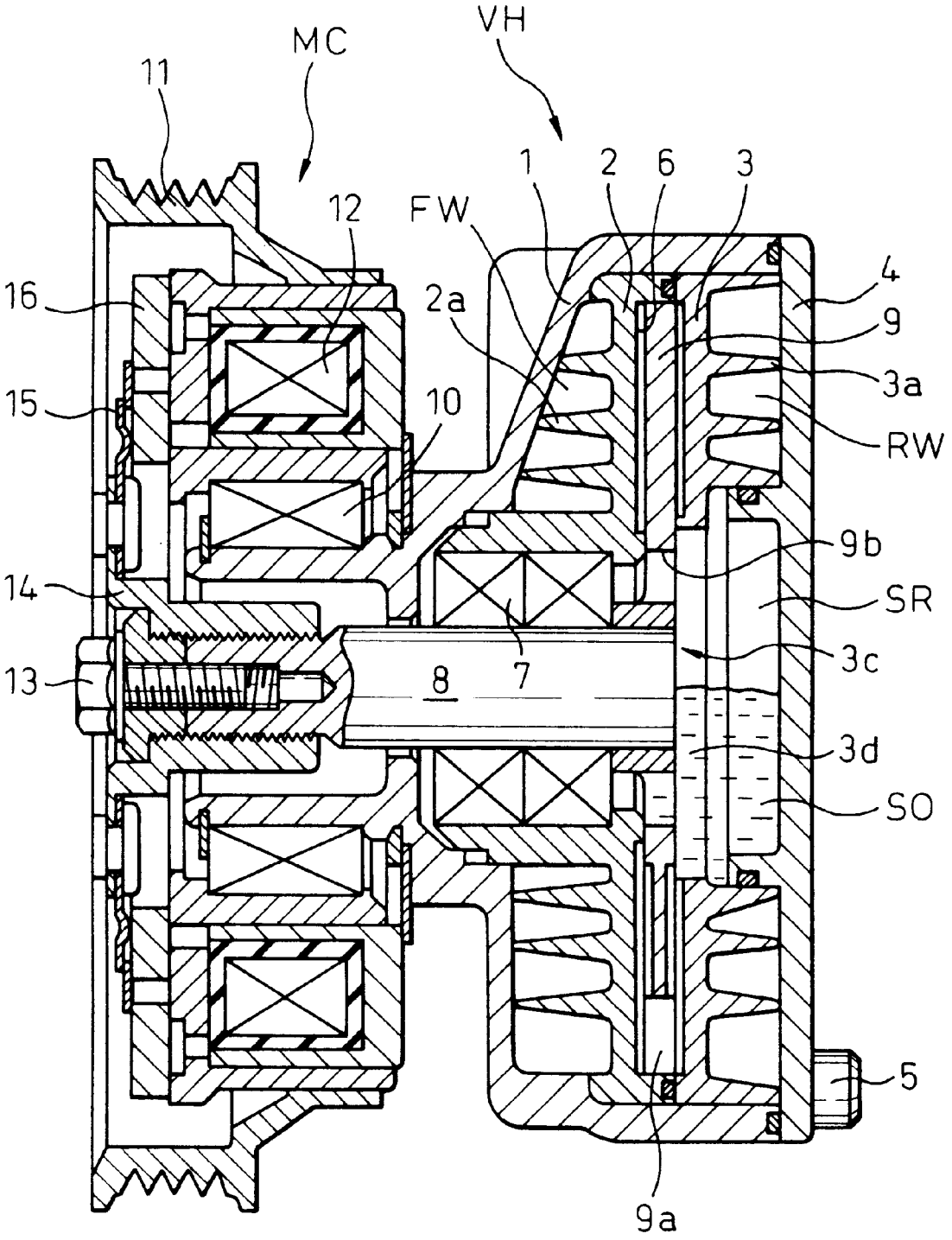
FIG. 1 is a longitudinal cross-sectional view of a heat generating apparatus according to a first embodiment of the present invention.

Referring to FIGS. 1 through 4, a heat generating apparatus of the first embodiment of the present invention, i.e., a viscous fluid type heat generator VH is provided with a housing assembly including a front housing body 1, a front plate element 2, an approximately ring-form rear plate element 3, and a rear housing body 4 which are axially combined together by a plurality of screw bolts 5, and O-rings (sealing elements) are interposed between two respective neighboring elements. The front plate element 2 is provided with a circular recess formed in a rear face (a right side face of FIG. 1) thereof, and the circular recess of the front plate element 2 faces a front face (a left side face of FIG. 1) of the rear plate element 3 to define a heat generating region 6 therebetween.

The rear plate element 3 cooperates with the rear housing body 4 to define a fluid storing region SR therebetween. The heat generating region 6 and the fluid storing region SR forms a working chamber of the heat generator VH.

The front plate element 2 is provided with a plurality of circularly extending fins 2*a* arranged coaxially. The fins 2*a* project frontward from a base portion of the front plate element 2 and cooperate with the front housing body 1 to define a front heat receiving chamber or a front water jacket FW.

The rear plate element 3 is provided with a plurality of circularly extending fins 3*a* arranged coaxially and project rearward from a base portion of the rear plate element 3. The fins 3*a* of the rear plate element 3 cooperate with an inner face of the rear housing body 4 to define a rear heat receiving chamber or a rear water jacket RW. The front and rear heat emitting chambers FW and RW permit a heat exchanging liquid such as a cooling water of a vehicle engine to flow therethrough while contacting with the front and rear fins 2*a* and 3*a*. The heat exchanging liquid receives heat emitting from the heat generating region 6 via the front and rear plate elements 2 and 3. The front and rear fins 2*a* and 3*a* function to increase the heat emitting area of the front and rear plate elements 2 and 3.

The front plate element 2 is provided with a central bore for receiving a shaft-sealing-element incorporated bearing unit 7 by which a drive shaft 8 is rotatably supported. Alternatively, a shaft sealing element and a bearing unit may be separately received in the central bore of the front plate element 2 to rotatably support the drive shaft 8.

The drive shaft 8 has an outer end extending outward from the bearing unit 7 to receive a drive power from a later-described external drive source, and an inner end extending toward the heat generating region 6 of the working chamber. The inner end of the drive shaft 8 supports thereon a rotor element 9 to be rotatable together with the drive shaft 8. Namely, the rotor element 9 is press-fitted on the inner end of the drive shaft 8 and arranged in the heat generating region 6. The rotor element 9 formed as a circular plate is provided with opposite circular outer faces and a circumferential face between the circular faces, and defines fluid-filled gaps between the outer faces and the front and rear plate elements 2 and 3.

The fluid storing region SR is formed to be able to store a predetermined amount of viscous fluid, i.e., silicone oil "SO" therein, and the predetermined amount of silicone oil is determined so that the stored silicone oil occupies a volume larger than the volume of the above-mentioned fluid-filled gaps of the heat generating region 6. A filling rate of the silicone oil into the fluid-filled gaps between the front and rear plate elements 2 and 3 and the outer faces of the rotor element 9 and the fluid storing region SR is determined to be substantially 70% with respect to the entire volume of the fluid-filled gaps and the fluid storing region SR, and the remaining 30% of the entire volume of the fluid-filled gaps and the fluid storing region SR is occupied by air.

Figure 3:
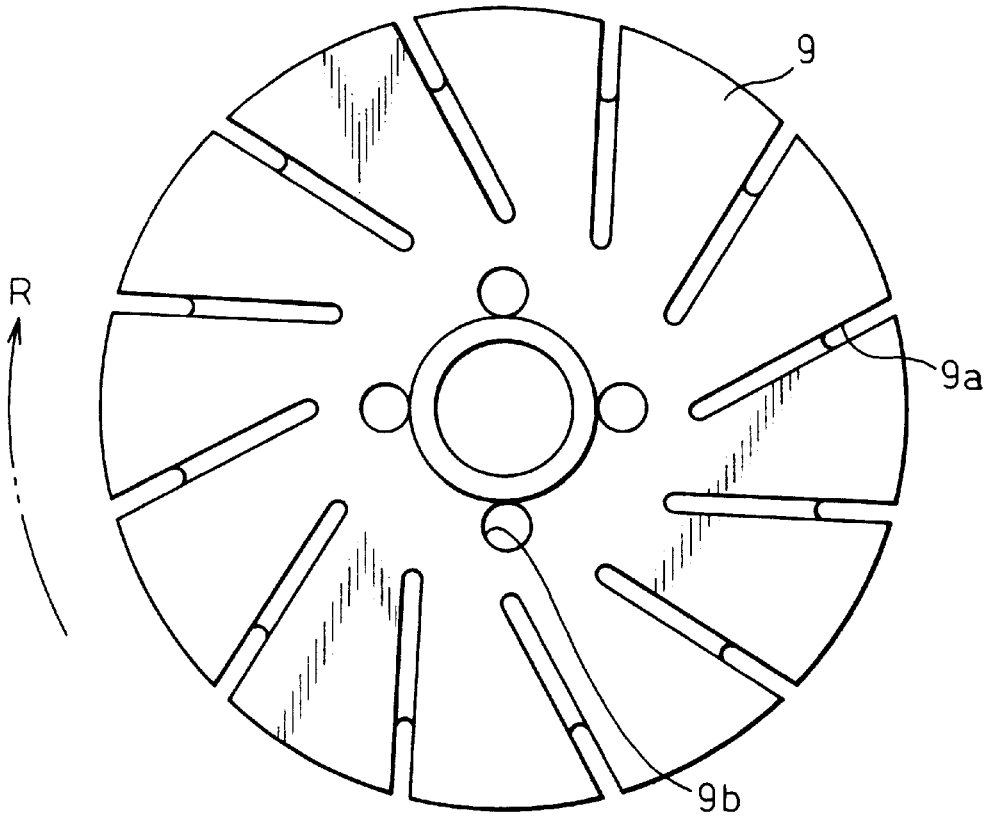
FIG. 3 is a end view of a rotor element accommodated in the heat generating apparatus of FIG. 1, illustrating construction thereof.

As shown in FIG. 3, the rotor element 9 in the shape of a circular plate is provided with a plurality of guide grooves 9*a* formed on both outer faces to extend substantially radially but to be inclined in a direction reverse to a rotating direction "R" of the rotor element 9. Each of the guide grooves 9*a* in each of the outer faces has an inner non-through-groove portion arranged radially inside of the rotor element 9 and an outer through-groove portion arranged radially outside of the rotor element 9. These guide grooves 9*a* of the rotor element 9 are provided for increasing a shearing action applied to the silicone oil and for conducting the silicone oil from the heat generating region 6 toward the outer region between the outer circumference of the rotor element 9 and a facing inner circular wall portion of the working chamber when the rotor element 9 is rotated in the direction "R" in the heat generating region.

The rotor element 9 is also provided with a plurality of communicating holes 9*b* having the shape of through-holes, and arranged in a central region thereof. The communicating holes 9*b* are arranged for providing a fluid communication between front and rear portions of the working chamber separated by the rotor element 9. The communicating holes 9*b* further function to provide the silicone oil in the working chamber with a stirring effect in response to the rotation of the rotor element 9.

Figure 2:
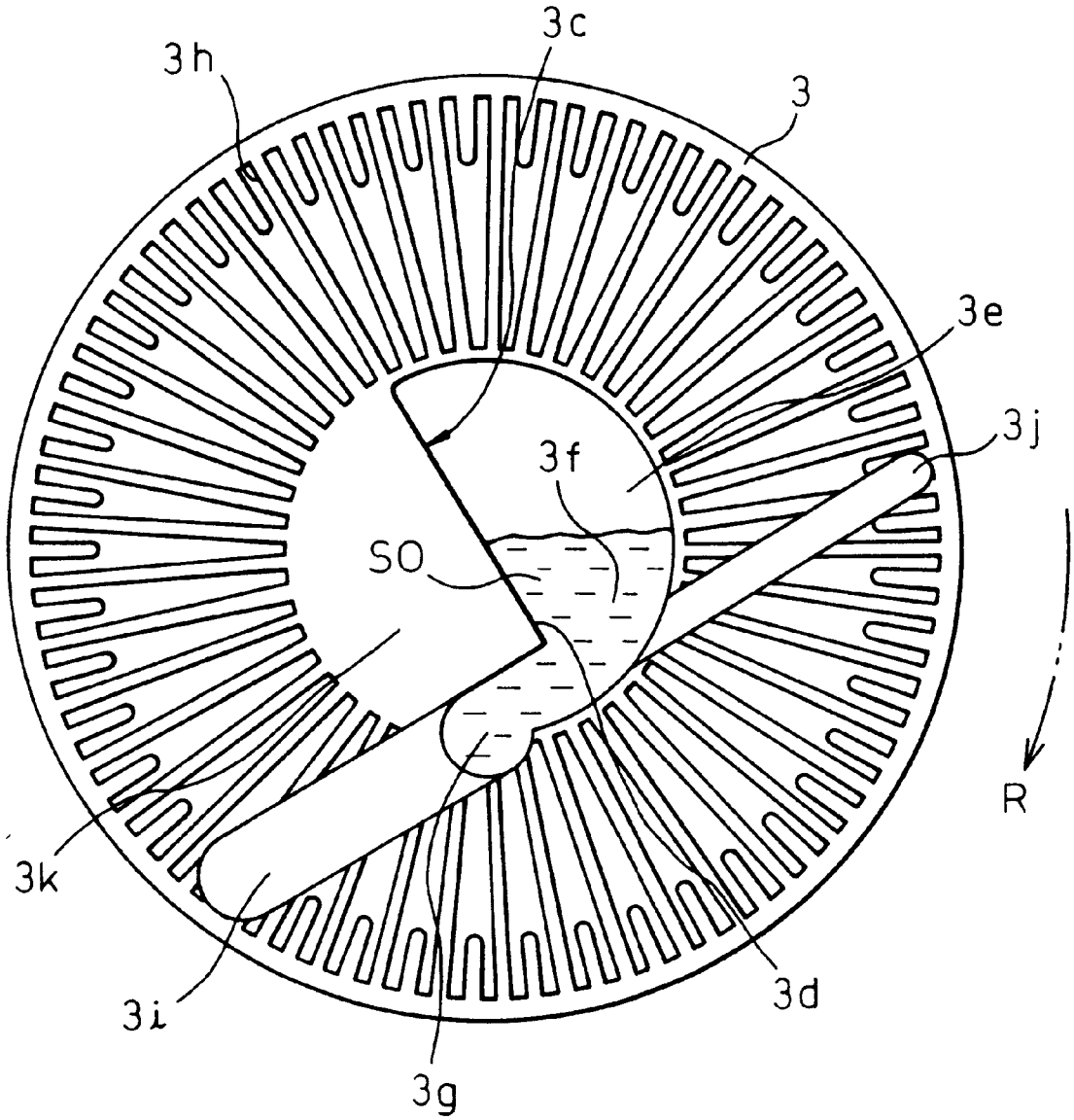
FIG. 2 is an end view of a rear plate element of the heat generating apparatus of FIG. 1, illustrating a construction thereof.

As shown in FIG. 2, the rear plate element 3 is arranged to provide a partition wall between the heat generating and fluid storing regions 6 and SR of the working chamber. Namely, the rear plate element 3 is provided with, at its central region, an aperture 3*c* having a portion thereof extending above the level of the silicone oil "SO" held in the fluid storing region SR. The rear plate element 3 is further provided, at its central region, with a wall portion 3*k* having a linear edge portion 3*d* with a square corner, and the linear edge portion 3*d* defines a portion of the side of the aperture 3*c*. The square corner of the linear edge portion 3*d* of the wall portion 3*k* is arranged so as to form a projection opposing to the rotating direction "R" of the rotor element 9.

The aperture 3*c* of the rear plate element 3 has a gas-phase-communicating portion 3*e* located in an air-filled portion of the fluid storing region SR, and a liquid-phase-communicating portion 3*f* located in a silicone oil-filled portion of the fluid storing region SR. The aperture 3*c* further has a fluid-supply portion 3*g* formed to be integral with the liquid-phase-communicating portion 3*f* and extending from the liquid-phase-communicating portion 3*f* in a direction corresponding to the rotating direction "R" of the rotor element 9. The fluid-supply portion 3*g* of the aperture 3*c* is located in the lowermost portion of the fluid storing region SR. Thus, the heat generating region 6 and the fluid storing region SR of the working chamber are arranged on different sides of the rear plate element 3 and communicate with one another via the central aperture 3*c* of the element 3. The wall portion 3*k* of the rear plate 3 functions to urge the silicone oil "SO" to perform a circulatory movement through the heat generating and fluid storing regions 6 and "SR" as described later.

The rear plate element 3 is further provided with a fluid-supply groove 3*i* extending from the fluid-supply portion 3*g* of the aperture 3*c*. The fluid-supply groove 3*i* is recessed in the surface of the rear plate element 3 to form a downwardly inclined trough by which the silicone oil in the fluid storing region SR is conducted from the fluid-supply portion 3*g* of the aperture 3*c* toward the outer circumferential portion of the heat generating region 6. Namely, the fluid-supply groove 3*i* extends from the fluid-supply portion 3*g* to the outer portion of the rear plate 3 so as to urge the silicone oil "SO" to be moved from the fluid-supply portion 3*g* toward the outer circumferential portion of the heat generating region 6 in response to the rotation of the rotor element 9 in the direction "R".

The rear plate element 3 is further provided with a groove 3*j* formed in the same surface as the above-mentioned fluid-supply groove 3*i*. The groove 3*j* is formed as an upwardly inclined tough extending from the liquid-phase-communicating portion 3*f* of the aperture 3*c* of the rear plate element 3 toward the outer portion of the heat generating region 6 of the working chamber, and functions as a fluid-collecting groove for collecting the silicone oil "SO" from the outer portion of the heat generating region into the liquid-phase-communicating portion 3*f* of the aperture 3*c* in the fluid storing region SR.

The rear plate element 3 is further provided with a plurality of radial grooves 3*h* formed in the face thereof facing the working chamber. The grooves 3*h* of the rear plate element 3 are provided for increasing the shearing effect applied to the silicone oil "SO" in the heat generating region 6 when the rotor element 9 is rotated in the working chamber. Also, the radial grooves 3*h* can contribute to an increase in the heat transmitting area of the rear plate element 3 through which heat is transmitted from the working chamber to the rear heat receiving chamber during the operation of the viscous fluid type heat generator VH.

Although not specifically shown, the front plate element 2 is provided with a construction similar to the above-described rear plate element 3 except for the aperture 3*c*. Namely, an inner surface of the front plate element 2 defining the working chamber has a fluid-supply groove, a fluid-collecting groove, and a plurality of radial shearing-increase-grooves.

As shown in FIG. 1, the drive shaft 8 of the viscous fluid type heat generator VH is arranged to be connectable to an external drive source via a solenoid clutch MC mounted on both the drive shaft 8 and the front housing body 1. The solenoid clutch MC includes a pulley 11 rotatably mounted on the front housing body 1 of the viscous fluid type heat generator VH via a bearing unit 10, and an electromagnetic coil 12 housed in the inside of the pulley 11. The electromagnetic coil 12 is electrically connected to an electronic computer unit ECU (not shown in FIG. 1) so as to be controlled by the unit ECU.

The drive shaft 8 of the heat generator VH is provided with a hub member 14 threadedly connected thereto by a screw bolt 13, and the hub member 14 is connected to an armature 16 via a plurality of leaf springs 15. The pulley 11 is operatively connected to the external drive source such as a vehicle engine via a belt (not shown in FIG. 1), so that the pulley 11 is rotationally driven by the drive source.

The description of the operation of the above-described viscous fluid type heat generator will be provided below.

When the electromagnetic coil 12 of the solenoid clutch MC is energized under the control of the electronic computer unit ECU, the armature 16 is magnetically attracted to the pulley 11, and accordingly, the drive shaft 8 is rotationally driven. Therefore, the rotor element 9 of the viscous fluid type heat generator VH rotates in the working chamber to apply a shearing action to the silicone oil "SO" in the heat generating region 6 of the working chamber. Thus, the silicone oil frictionally generates heat within the heat generating gaps formed between the inner wall surfaces of the front and rear plate elements 2 and 3 and the outer faces of the rotor element 9. The generated heat is transmitted through the front and rear plate elements 2 and 3 and is emitted to the heat exchanging liquid flowing through the front and rear heat receiving chambers (the front and rear water jackets) FW and RW. Thus the heat exchanging liquid further flowing through the engine cooling system of a vehicle carries the heat to a heat core of the vehicle's heating system, and accordingly, the heat is applied to an objective heated area, i.e., a passenger compartment of the vehicle. When the vehicle engine is cool, the heat exchanging liquid applies heat to the engine for warming up.

During the heat generating operation of the viscous fluid type heat generator VH, the working chamber including the heat generating region 6 and the fluid storing region SR is filled with silicone oil and the air. Therefore, when the silicone oil "SO" in the heat generating region 6 is thermally expanded, the air held in the fluid storing region SR directly absorbs the thermal expansion of the silicone oil "SO" via the gas-phase-communicating portion 3*e* of the aperture 3*c* of the rear plate element 3.

Further, in the described viscous fluid type heat generator VH, the square corner of the linear edge portion 3*d* conducts the silicone oil "SO" in the fluid storing region SR toward the fluid-supply portion 3*g* of the aperture 3*c* in response to the rotation of the rotor element 9. Accordingly, the fluid-supply portion 3*g* supplies the silicone oil "SO" into the heat generating region 6 in response to the rotation of the rotor element 9. Thus, the fluid-supply groove 3*i* of the rear plate element 3 conducts the silicone oil carried from the fluid storing region SR toward the outer circumferential portion of the heat generating region 6 where the most active heat generation takes place. Therefore, a quick circulatory movement of the silicone oil "SO" occurs between the fluid storing region SR and the heat generating region 6.

Further, at the start of the operation of the viscous fluid type heat generator VH, the heat generator quickly starts heat generation due to the above-mentioned supply of the silicone oil from the fluid storing region SR to the outer circumferential portion of the heat generating region 6.

During the operation of the heat generator VH, the gas-phase-communicating portion 3*e* and the liquid-phase-communicating portion 3*f* of the aperture 3*c* of the rear plate element 3 function to collect the silicone oil "SO" from the heat generating region 6. At this stage, the relatively narrow liquid-collecting groove 3*j* of the rear plate element 3, which fluidly communicates with the liquid-phase-communicating portion 3*f* of the aperture 3*c* conducts a small amount of the silicone oil "SO" from the outer circumferential portion of the heat generating region 6 toward the aperture 3*c*. Thus, collection of the silicone oil "SO" from the outer circumferential portion of the heat generating region 6 can be suppressed so as to accelerate heat generation of the silicone oil "SO" at the start of operation of the viscous fluid type heat generator VH.

It will be understood that, in the described heat generator VH, the heat generating region 6 and heat storing region SR are formed in the common working chamber and the aperture 3*c* of the rear plate element 3 functions as both fluid-collecting and fluid-supply passages. Therefore, the silicone oil "SO" can actively perform a circulatory movement through the heat generating region 6 and the fluid storing region SR. Namely, there is provided no throttle-like fluid collecting passage between the heat generating region 6 and the fluid storing region SR. Thus, the heat generating apparatus of the first embodiment of the present invention is clearly different from the conventional viscous fluid type heat generator as disclosed in U.S. Pat. '778 which is provided with a throttle-like collecting passage between the heat generating chamber and the fluid storing chamber. Further, since the communicating holes 9*b* of the rotor element 9 work so as to positively stir the silicone oil "SO" in the working chamber including the heat storing region SR due to the rotation of the rotor element 9, the high temperature and low viscosity component of the silicone oil "SO" and the low temperature and high viscosity component of the silicone oil "SO" can be constantly mixed together in the heat generating and fluid storing regions 6 and SR of the working chamber, and accordingly, the temperature and the viscosity of the silicone oil "SO" filled in the working chamber can be kept generally constant during the operation of the viscous fluid type heat generator VH. Accordingly, in the heat generator VH, heat generation of only a part of the filled silicone oil "SO" held in the heat generating region 6 does not occur, and all of the silicone oil "SO" filled in working chamber contributes to the heat generation in the heat generating region 6. Therefore, thermal degradation of the silicone oil can be prevented. Further, even if the heat generator VH runs with a high speed rotation of the drive shaft 8 and the rotor element 9, or at a normal speed for a long operating time, no appreciable increase in the pressure level in the working chamber occurs and, accordingly, leakage of the silicone oil "SO" from the heat generator VH does not occur. Thus, the heat generator VH can exhibit a long operating life without causing a reduction in a heat generating performance.

It should be understood that the described viscous fluid type heat generator VH according to the present invention does not need to have the silicone oil "SO" periodically replaced with a fresh silicone oil. Therefore, the heat generator VH once mounted on a vehicle does not need to be dismounted and disassembled for the purpose of replacing the silicone oil. Thus, no cumbersome maintenance operation is required.

Further, the heat generator VH can reduce the amount of the silicone oil "SO" held in the heat generating region 6 when the operation thereof is started. Thus, it is possible to reduce a starting torque necessary for driving the heat generator VH. Thus, in the vehicle mounting thereon the heat generator VH of the present invention, the cranking motor of the vehicle for starting the operation of the vehicle engine can be surely and easily operated by a vehicle driver. Furthermore, if the solenoid clutch MC is a small capacity type clutch, the drive power from the vehicle engine is surely connected to the drive shaft 8 of the heat generator VH without causing slipping of the solenoid clutch MC and the pulley belt. Therefore, even when the heat generator VH is started during the running of the vehicle, no shock is transmitted to the vehicle engine, and accordingly, an unpleasant feeling is not transmitted to the vehicle driver.

Therefore, the viscous fluid type heat generator VH according to the first embodiment of the present invention can be a heat generating apparatus suitable for being accommodated in a vehicle heating system, which is able to prevent degradation in the physical property of the viscous fluid, typically a silicone oil, realize a reduction in the starting torque thereof, and avoid leakage of the viscous fluid (the silicone oil "SO") from the working chamber thereof even if the heat generating apparatus is operated under very severe operating conditions such as at a very high speed or at a normal speed but for a long time.

The inventors conducted experiments to evaluate the heat generating performances of three samples of a heat generator, i.e., the first sample is a heat generator VH according to the first embodiment of the present invention, the second sample is a first comparative heat generator according to U.S. Pat. No. 4,974,778 (DE-A-3832966), and the third sample is a second comparative heat generator according to Japanese Unexamined Patent Publication (Kokai) No. 8-33110 (DE-A-687584). In the experiments, the three sample heat generators were operated at a nominal rotating speed, i.e., 1,500 r.p.m., and a pressure level (kgf/$cm^2$ gage) prevailing in the heat generating region of the working chamber of the heat generator VH, and the heat generating chambers of the first and second comparative heat generators were measured. The results of the experiments are shown in the graph of FIG. 4.

Figure 4:
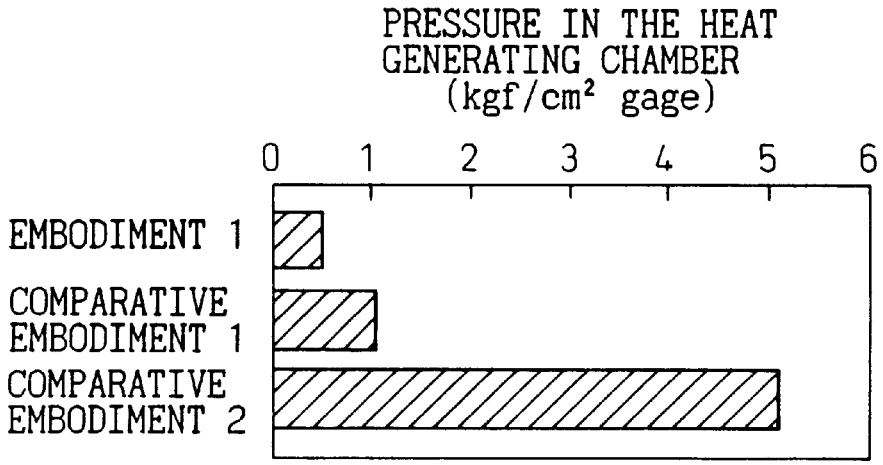
FIG. 4 is a graphical view indicating pressure prevailing in a heat generating region of the heat generating apparatus according to the first embodiment of the present invention and pressures prevailing in the heat generating chambers of two comparative examples of viscous fluid type heat generators.

From the indication of FIG. 4, it is understood that when the first and second comparative heat generators were operated for a long continuous time, the pressure levels in the heat generating chambers became considerably higher than that prevailing in the heat generating region of the working chamber of the heat generator VH. Thus, the viscous fluid (the silicone oil) of the comparative first and second heat generators is apt to leak therefrom due to an increase in the internal pressures of the first and second comparative heat generators. Thus, it was confirmed that the comparative heat generators must be provided with a pressure-resistant shaft sealing device to prevent the viscous fluid from leaking from the heat generators when the heat generators are operated under a severe operating condition. Thus, the manufacturing cost of these heat generators must be high.

On the other hand, in the viscous fluid type heat generator according to the first embodiment of the present invention, it is understood that the pressure level prevailing in the heat generator can be constantly maintained at a low level compared with the first and second comparative heat generators. Thus, the leakage of the viscous fluid (the silicone oil) can be avoided without employing an expensive shaft sealing device. Therefore, the manufacturing cost of the viscous fluid type heat generator can be reduced.

Figure 5:
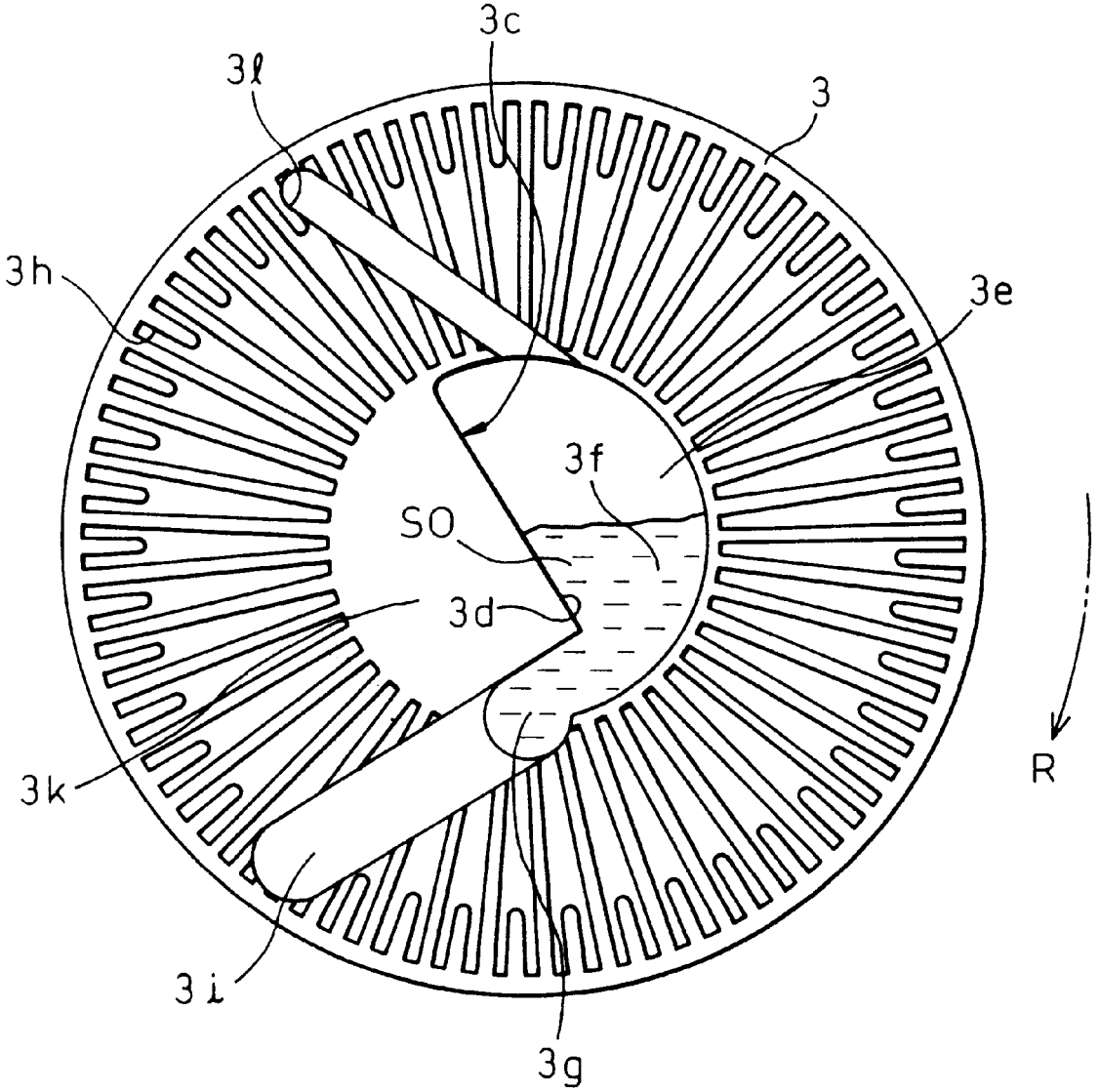
FIG. 5 is an end view of a rear plate accommodated in a second embodiment of the present invention, illustrating the construction thereof.

FIG. 5 illustrates a heat generating apparatus according to a second embodiment of the present invention. The heating apparatus of the second embodiment, i.e., a viscous fluid type heat generator VH has substantially the same internal construction as that of the first embodiment of FIGS. 1 through 3. However, as will be clearly understood from comparison of FIG. 5 with FIG. 2, a rear plate element 3 of the second embodiment is different from that of the first embodiment. Namely, the rear plate element 3 of the second embodiment is provided with a fluid-collecting groove 3*l* which is different from the fluid-collecting groove 3*j* of the first embodiment. The fluid-collecting groove 3*l* is recessed in a surface of the rear plate element 3 so as to extend from a radially outer portion of the heat generating region 6 to the gas-phase-communicating portion 3*e*, and is inclined from a radial direction of the rear plate element 3 in a direction reverse to the rotating direction "R" of the rotor element 9. The fluid-collecting groove 3*l* conducts the silicone oil "SO" from the radially outer portion of the heat generating region 6 toward the gas-phase-communicating portion 3*e* of the aperture 3*c* of the rear plate element 3.

It should be understood that since the construction of the rear plate element 3 of the second embodiment except for the above-mentioned fluid-collecting groove 3*l* is substantially the same as that of the first embodiment, the respective portions of the rear plate element 3 are designated by the same reference numerals as those of the first embodiment, and a detailed description of the respective portions is omitted.

The viscous fluid type heat generator VH according to the second embodiment is characterized in that, since a large amount of silicone oil "SO" is conducted from the radially outer portion of the heat generating region 6 to the gas-phase-communicating portion 3*e* of the aperture 3*c* by the fluid-collecting groove 3*l*, appropriate collection of the silicone oil "SO" from the heating region 6 into the fluid storing region SR of the working chamber is effectively achieved. Therefore, degradation of the physical properties of the silicone oil "SO" filled in the heat generator VH can be suitably prevented. The general heat generating operation of the heat generator VH of the second embodiment is substantially the same as that of the first embodiment.

Figure 6:
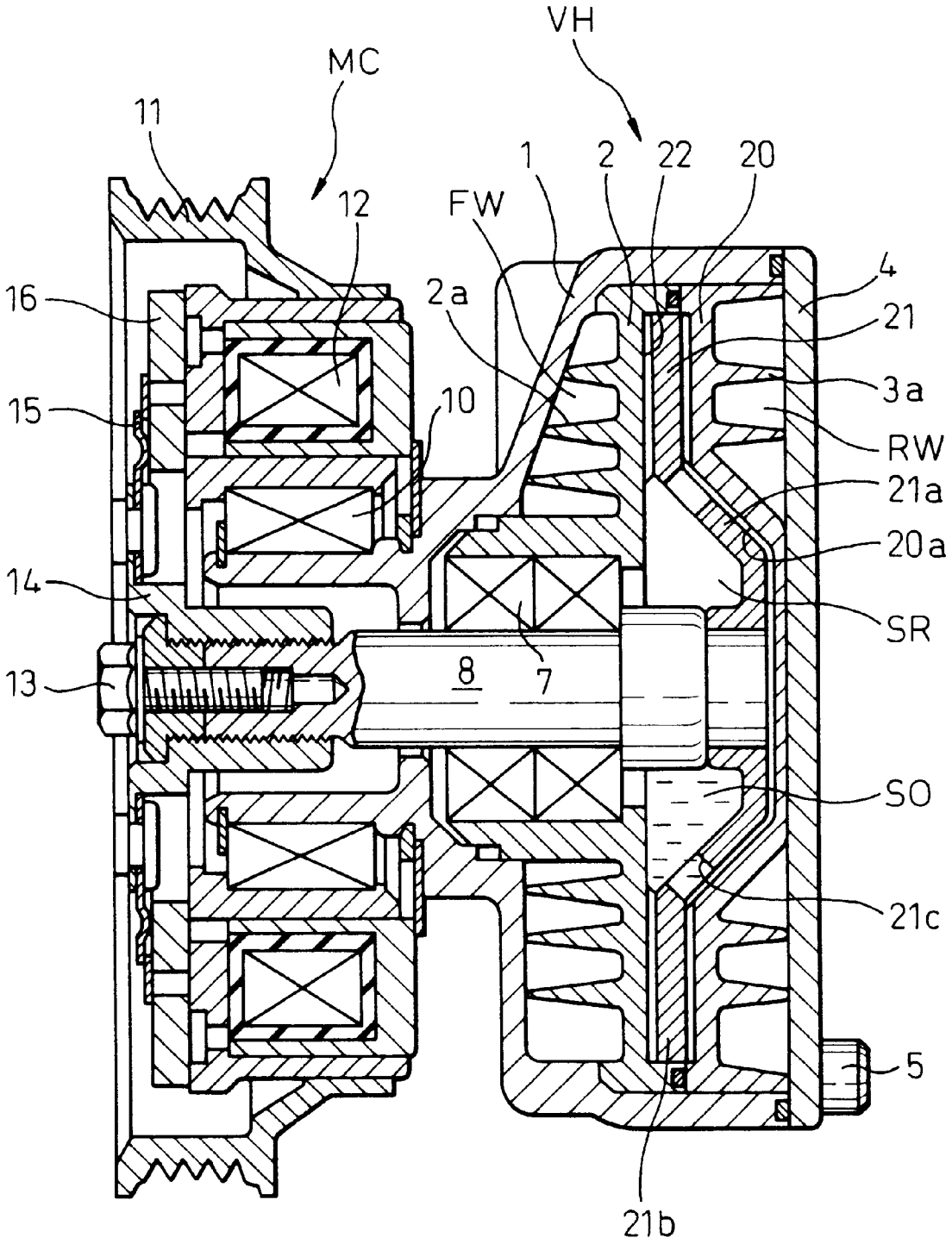
FIG. 6 is a longitudinal cross-sectional view of a heat generating apparatus according to a third embodiment of the present invention, illustrating an internal condition of the apparatus before the start of the operation thereof.
Figure 7:
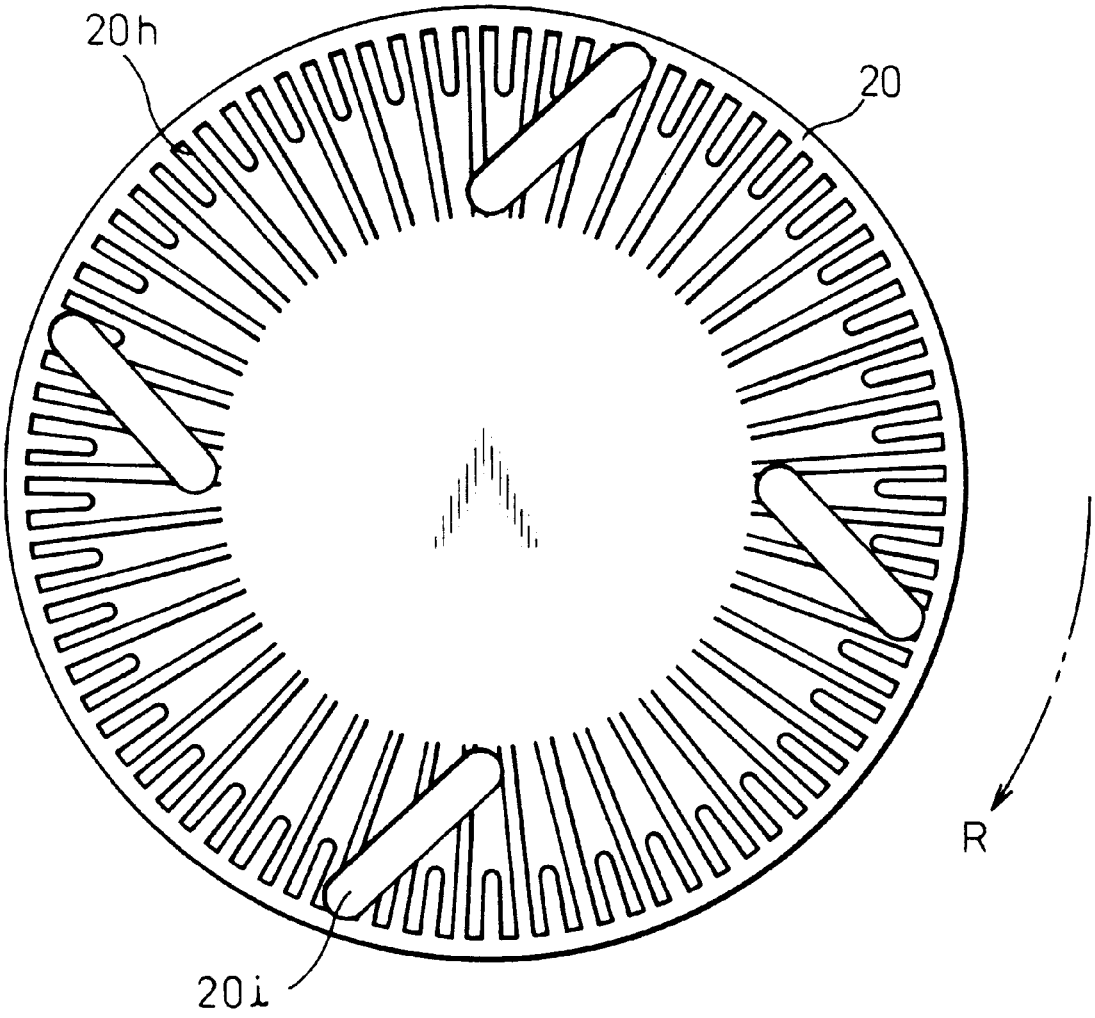
FIG. 7 is an end view of a rear plate accommodated in the third embodiment of the present invention, illustrating the construction thereof.
Figure 8:
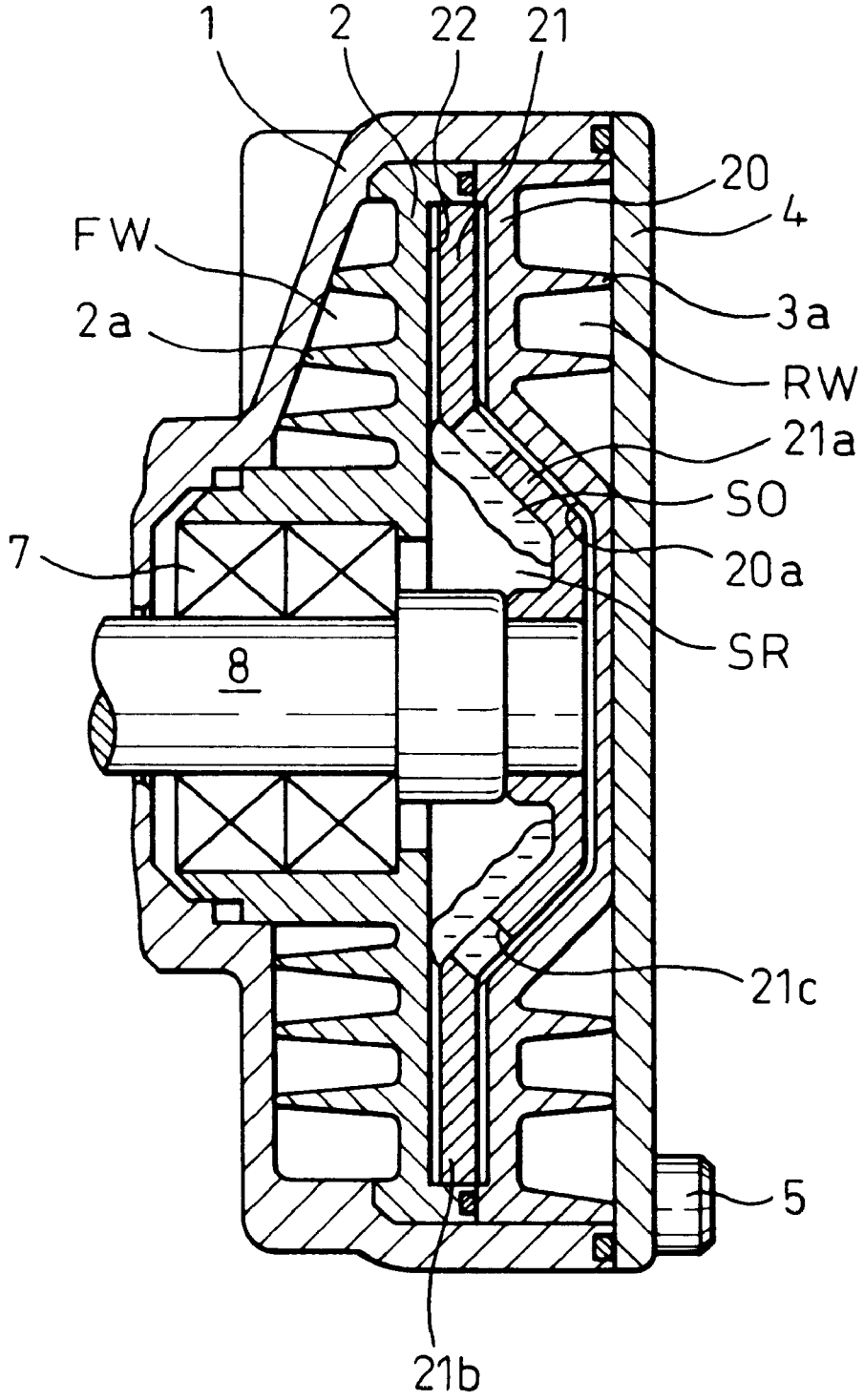
FIG. 8 is a cross-sectional view of an important portion of the heat generating apparatus of the third embodiment, illustrating an internal condition thereof after the start of the operation thereof; and, FIG. 9 is a longitudinal cross-sectional view of a heat generating apparatus according to a fourth embodiment of the present invention, illustrating an internal condition thereof before the start of the operation thereof.

FIGS. 6 through 8 illustrate a heat generating apparatus according to a third embodiment of the present invention. The heat generating apparatus of the third embodiment, formed as a viscous fluid type heat generator VH, is provided with a rear plate element 20 which is obviously different from the flat-disc shape rear plate elements 3 of the first and second embodiments. The rear plate element 20 is provided with, at its central portion, an axially rearwardly recessed portion 20*a*. The recessed portion 20*a* of the rear plate element 20 is arranged to face an inner face of a flat rear housing body 4, and cooperates with the rear housing body 4 to define a rear heat receiving chamber RW (the rear water jacket) extending all over the inner face of the rear housing body 4. Thus, there is no 0-ring element between the rear plate element 20 and the rear housing body 4.

The heat generator of the third embodiment is provided with a centrally recessed rotor element 21 which includes a central recessed portion 21*a* formed so as to be received in the recessed portion 20*a* of the rear plate element 20 in a face-to-face arrangement. The rotor element 21 is further provided with an annular flange portion 21*b* which is a flat portion radially extending from a circular outer end of the recessed portion 21*a*. The recessed portion 21*a* of the rotor element 21 is provided with a plurality of communicating holes 21*c* bored through d portion thereof adjacent to the circular outer end thereof. The recessed portion 21*a* of the rotor element 21 axially faces an inner face of a front plate element 2 and defines a fluid storing region, SR having a relatively large volume, therein. The annular flange portion 21*b* of the rotor element 21 defines front and rear annular gaps arranged between annularly extending inner faces of the front and rear plate elements 2 and 20 and the outer faces of the flange portion 21*b* per se. The annular gaps form a heat generating region 22 which constitutes, in cooperation with the fluid storing region SR, the working chamber of the heat generator VH of the third embodiment. The heat generating and fluid storing regions 22 and SR communicate with one another via the communicating holes 21*c*.

As shown in FIG. 7, the rear plate 20 is provided with a plurality of fluid-supply grooves 20*i* formed in the annular inner face thereof facing the rear outer face of the flange portion 21*b* of the rotor element 21. Each of the fluid-supply grooves 20*i* extends generally radially and is inclined from a true radial direction of the rear plate 20 in a direction corresponding to the rotating direction "R" of the rotor element 21. The fluid-supply grooves 20*i* are arranged as conducting passages for urging the silicone oil "SO" held in the heat generating region 22 to be radially moved toward the outer circumferential portion of the heat generating region 22.

The rear plate element 20 is further provided with a plurality of radial grooves 20*h* formed in the annular inner face thereof facing the rear outer face of the flange portion 21*b* of the rotor element 21. These radial grooves 20*h* function to increase a shearing action applied to the silicone oil "SO" held in the heat generating region 22 when the rotor element 21 is rotated. The radial grooves 20*h* also contribute to an increase in the heat transmitting area of the rear plate element 20. It should be understood that the annularly extending inner face of the front plate 2 which faces the heat generating region is provided with radial grooves similar to the radial grooves 20*h* of the rear plate element 20.

The internal construction of the heat generator VH of the third embodiment except for the above-described construction may be understood to be substantially the same as that of the first embodiment, and accordingly designated by the same reference numerals as those of the first embodiment. Accordingly, a further detailed description of the internal construction of the heat generator VH is omitted here.

In the viscous fluid type heat generator of the third embodiment, the silicone oil "SO" stored in the fluid storing region SR formed by the central recessed portion 21*a* of the rotor element 21 is subjected to a centrifugal force in response to the rotation of the rotor element 21. As a result, the silicone oil "SO" is pressed against the recessed face of the central recessed portion 21*a* of the rotor element 21 during the rotation thereof, as best shown in FIG. 8. Therefore a part of the silicone oil "SO" is urged to pass through the communicating holes 21*c* of the rotor element 21 into the heat generating region 22 located on the projecting side of the rotor element 21. Thus, the silicone oil "SO" entering the heat generating region on the projecting side of the rotor element 21 is then conducted by the fluid-supply grooves 20*i* toward the outer circumferential portion of the heat generating region 22. Therefore, the silicone oil "SO" conducted toward the outer circumferential portion of the heat generating region 22 via the communicating holes 21*c* and the fluid-supply grooves 20*i* presses the silicone oil "SO" already held in the heat generating region 22 formed by the front and rear annular gaps arranged between annularly extending inner faces of the front and rear plate elements 2 and 20 and the outer faces of the flange portion 21*b* of the rotor element 21, and accordingly, the latter silicone oil "SO" is urged to move into the fluid storing region SR having a volume sufficiently larger than the above-mentioned front and rear annular gaps of the heat generating region 22. Namely, the front and rear annular gaps in the working chamber further function as a fluid-collecting passage. Thus, a circulatory movement of the silicone oil "SO" is constantly performed within the working chamber of the heat generator VH during the operation thereof to prevent degradation in the physical property of the silicone oil "SO".

Further, the heat generator VH of the third embodiment of the present invention has a rear heat receiving chamber RW (the rear water jacket) of which the heat receiving area is larger than that of the rear heat receiving chamber RW of the first embodiment. Therefore, heat exchange performed between the heat generating region 22 of the working chamber and the rear heat receiving chamber RW is more appropriately conducted by the viscous fluid type heat generator of the third embodiment, compared with that of the first embodiment of the present invention. This appropriate heat exhcange between the heat generating region 22 and the rear heat receiving chamber RW provides the silicone oil "SO" held in the fluid storing region SR of the working chamber with a sufficient cooling effect. Thus, thermal degradation of the silicone oil "SO" filled in the heat generator VH can be reduced, and the operating life of the silicone oil can be extended.

Furthermore, since the viscous fluid type heat generator according to the third embodiment of the present invention requires no O-ring element between the rear plate element 20 and the rear housing body 4, a reduction in the number of elements of the heat generator VH can be achieved. Thus, the assembly of the heat generator VH can be simplified resulting in a reduction in the manufacturing cost of the heat generator VH.

When the rotor element 21 of the heat generator VH of the third embodiment is rotated, the silicone oil subjected to the centrifugal force due to the rotation of the rotor element 21 is prevented from flowing toward the shaft-seal-device-incorporated bearing device 7. Therefore, prevention of leakage of the silicone oil "SO" from the interior of the heat generator VH of the third embodiment can be achieved.

Figure 9:
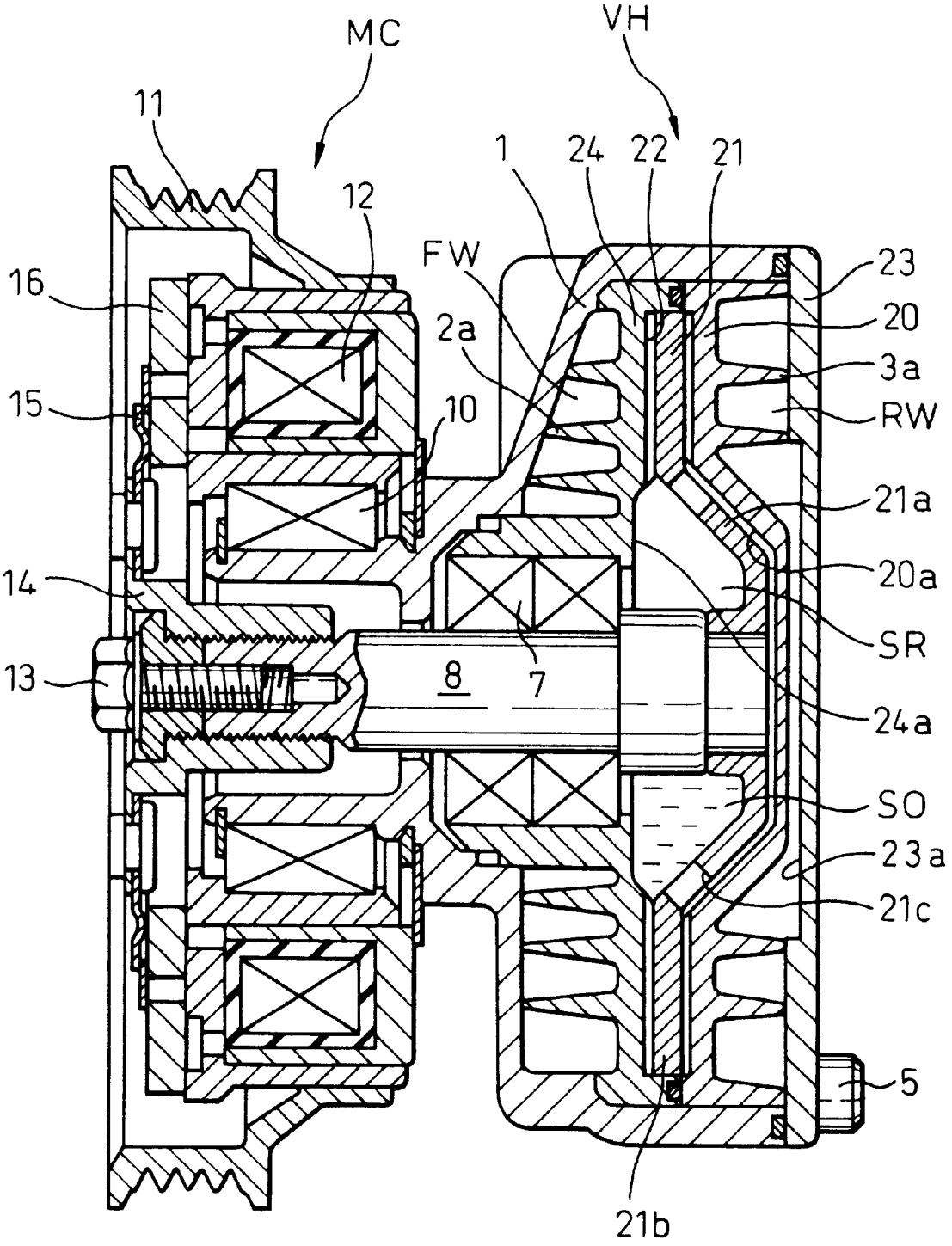

FIG. 9 illustrates a viscous fluid type heat generator VH forming a heat generating apparatus of a fourth embodiment of the present invention. The heat generator VH of the fourth embodiment is modified from the heat generator VH of the above-described third embodiment.

The heat generator VH of the fourth embodiment is provided with a rear housing body 23 having a central recess 23*a* formed in an inner face thereof. Therefore, the recessed portion 20*a* of the rear plate element 20 is sufficiently separated from the inner face of the rear housing body 23. Further, a front plate element 24 of the heat generator VH of the fourth embodiment is provided with a central recessed portion 24*a* formed so as to increase an entire volume of the fluid storing region SR of the working chamber compared with that of the fluid storing region SR of the third embodiment.

In the heat generator VH according to the fourth embodiment, the shape of the fluid storing region SR is substantially identical to that of the fluid storing region SR of the third embodiment. However, the volume of the fluid storing region SR is larger than that of the fluid storing region SR of the third embodiment. Therefore, the silicone oil "SO" in the working chamber of the heat generator VH of the fourth embodiment is further promoted to perform a circulatory movement through the heat generating region 22 and the fluid storing region SR in comparison with the third embodiment. Thus, the advantages obtained from the fourth embodiment is intensified from those obtained from the third embodiment.

Further, in the heat generator VH of the fourth embodiment, the heat receiving area of the rear heat receiving chamber RW (the rear water jacket) is increased from that of the third embodiment. Therefore, the heat exchange performed between the heat generating region 22 and the rear heat receiving chamber RW can be more effective than that performed by the third embodiment. Thus, the heat generating performance of the heat generator VH of the fourth embodiment can be improved over that of the heat generator VH of the third embodiment. Furthermore, the cooling of the silicone oil held in the fluid storing region SR can be appropriately achieved so as to prevent thermal degradation of the silicone oil "SO" resulting in an prolonging of the operating life of the silicone oil "SO".

From the foregoing description of the preferred embodiments of the present invention, it will be understood that according to the present invention, prevention of degradation of the viscous fluid filled in the heat generating apparatus, a reduction in the starting torque of the heat generating apparatus, and prevention of leakage of the viscous fluid from the heat generating apparatus even when the apparatus is operated under a very severe operating condition can be appropriately achieved.

Various changes and modifications to the described embodiment of the present invention will occur to a person skilled in the art without departing from the scope and spirit of the invention claimed in the accompanying claims.

We claim:

1. A heat generating apparatus comprising:

a housing assembly having a working chamber for heat generation, and a heat receiving chamber arranged adjacent to the working chamber and permitting a heat exchanging liquid to flow therethrough;

a drive shaft having outer and inner opposite ends and rotatably supported in said housing assembly via a bearing unit;

a rotor element supported on said drive shaft to be rotatable in said working chamber and having outer faces thereof;

a viscous fluid and a given amount of air filled within said working chamber;

wherein said working chamber defines therein:

a heat generating region including a heat generating gap formed between said outer faces of said rotor element and an inner wall surface of said working chamber to generate heat when the viscous fluid is subjected to a shearing action within said heat generating gap by the rotation of said rotor element;

a fluid storing region forming the remainder of said working chamber and storing a predetermined amount of viscous fluid of which the volume is larger than that of said heat generating gap, said fluid storing region being arranged for permitting the viscous fluid to move therefrom to said heat generating region and vice versa; and wherein said working chamber has a partition wall arranged between said heat generating region and said fluid storing region, said partition wall being provided with an aperture having an extension sufficient for providing a communication between said heat generating and fluid storing regions above the level of the viscous fluid stored in said fluid storing region.

2. The apparatus according to claim 1 wherein said partition wall is provided with an edge portion formed opposite to a rotating direction of said rotor element, and wherein said aperture of said partition wall has a gas-phase communicating portion defined by said edge portion and disposed in a gas-phase zone in said fluid storing region, a liquid-phase communicating portion disposed in a liquid-phase zone in said fluid storing region, and a liquid-supply portion arranged to be integral with said liquid-phase communicating portion and defined by said edge portion to extend in a direction corresponding to the rotating direction of said rotor element, said liquid-supply portion being disposed at the lowest portion of said fluid storing region.

3. The apparatus according to claim 1, wherein said working chamber is provided with a fluid supply means for supplying the viscous fluid from said fluid storing region to an outer circumferential portion of said heat generating region.

4. The apparatus according to claim 1, wherein said partition wall is provided with a fluid-collecting groove formed therein for conducting the viscous fluid from an outer circumferential portion of said heat generating region to said aperture of said partition wall.

5. The apparatus according to claim 1, wherein said fluid-collecting groove of said partition wall communicates with said gas-phase communicating portion of said aperture of said partition wall.

6. The apparatus according to claim 1, wherein said fluid-collecting groove communicates with said liquid-phase portion of said aperture of said partition wall.

7. A heat generating apparatus comprising:

a housing assembly having a working chamber for heat generation, and a heat receiving chamber arranged adjacent to the working chamber and permitting a heat exchanging liquid to flow therethrough;

a drive shaft having outer and inner opposite ends and rotatably supported in said housing assembly via a bearing unit;

a rotor element supported on said drive shaft to the rotatable in said working chamber and having outer faces thereof;

a viscous fluid and a given amount of air filled within said working chamber;

wherein said working chamber defines therein:

a heat generating region including a heat generating gap formed between said outer faces of said rotor element and an inner wall surface of said working chamber to generate heat when the viscous fluid is subjected to a shearing action within said heat generating gap by the rotation of said rotor element;

a fluid storing region forming the remainder of said working chamber and storing a predetermined amount of viscous fluid of which the volume is large than that of said heat generating gap, said fluid storing region being arranged for permitting the viscous fluid to move therefrom to said heat generating region and vice versa; and wherein said rotor element is provided with a recessed portion formed in a central portion thereof, and a flange portion extending radially from said recessed portion, said recessed portion of said rotor element cooperating with said housing assembly to define said fluid storing region of said working chamber, said flange portion cooperating with said housing assembly to define said heat generating region communicating with said fluid storing region via communicating holes bored through an outermost region of said recessed portion of said rotor element.

8. The apparatus according to claim 7, wherein said working chamber is provided with a recessed portion formed therein to enlarge said fluid storing region so that a volume of said fluid storing region is increased.

* * * * *